United States Patent [19]

Allenbach

[11] Patent Number: 5,074,065

[45] Date of Patent: Dec. 24, 1991

[54] IRONING DEVICE HAVING A VERTICALLY AND HORIZONTALLY TRANSPORTABLE IRONING PLATE

[76] Inventor: Georges Allenbach, 3 chemin de halage de Casamene, 25000 Bensancon, France

[21] Appl. No.: 450,624

[22] Filed: Dec. 14, 1989

[30] Foreign Application Priority Data

Dec. 15, 1988 [FR] France ..... 88 17039

[51] Int. Cl.[5] ..... D06F 71/04; D06F 71/14

[52] U.S. Cl. ..... 38/31; 38/103; 38/33; 38/35

[58] Field of Search ..... 38/5, 7, 8, 18, 22, 38/25, 27, 28, 30-35, 42, 43, 103, 104, 135; 248/117.1; 223/57, 57.1, 52.5; 112/119, 121.25

[56] References Cited

U.S. PATENT DOCUMENTS

| | | | |
|---|---|---|---|
| 229,758 | 7/1880 | Socias y Rubió | 38/30 |
| 1,689,015 | 10/1928 | Ellis | 38/28 |
| 1,699,458 | 1/1929 | Toll | 38/28 |
| 2,120,340 | 6/1938 | Rear | 38/18 X |
| 2,360,375 | 10/1944 | Tutiya | 112/121.25 X |
| 3,071,878 | 1/1963 | Beasley | 38/25 X |
| 4,862,608 | 9/1989 | Miyata | 38/31 |

FOREIGN PATENT DOCUMENTS

| | | | |
|---|---|---|---|
| 5009833 | 3/1985 | Japan | 112/121.15 |
| 0520822 | 5/1940 | United Kingdom | 38/18 |

*Primary Examiner*—Werner H. Schroeder
*Assistant Examiner*—Ismael Izaguirre
*Attorney, Agent, or Firm*—Weiser & Stapler

[57] ABSTRACT

An ironing device automatically moves an ironing plate across an ironing table. A pneumatic jack is arranged integral with the ironing plate, supported by a guide including at least two columns, and is adapted to displace the ironing plate vertically. First and second carriages cooperate with first and second motors for moving the ironing plate across the surface of the ironing table. A manual control allows motion of the ironing plate either along the main axes of the carriages or along two axes diagonal with respect to the other axes. In preferred embodiments of the invention, various safety devices are employed to prevent the hot ironing plate from moving into zones which would cause injury to the user.

12 Claims, 2 Drawing Sheets

IRONING DEVICE HAVING A VERTICALLY AND HORIZONTALLY TRANSPORTABLE IRONING PLATE

FIELD OF THE INVENTION

The subject of the present invention is a device intended for ironing articles made from textile, skin and leather such as garments and furnishings, installed on an ironing table and having a movable ironing plate which applies heat and steam and is mechanically assisted in its lowering, pressing and displacement in all directions over the article to be treated.

BACKGROUND OF THE INVENTION

In the field of ironing garments and other articles requiring this treatment, various types of equipment and means are known which are composed of one or more elements which apply heat or apply heat and steam, such as the traditional iron, manual presses, mechanized presses, roller machines, as well as air- and steam-pressure devices such as ironing dummies.

It is known that the traditional iron, indispensable for the treatment of some articles or parts of an article, although very widespread and satisfactory in its household use, has only a small working surface which makes this piece of equipment unsatisfactorily expensive for someone working in the ironing trade who, for reasons of productivity and profitability, currently needs to treat the articles or parts of an article which have a large surface area using means which are more productive and are more convenient to use.

It is also known that manual or mechanical ironing presses give very good results in terms of productivity and the quality of the work in ironing articles or parts of articles which have a large surface area or are compatible with the use of this means.

As for devices for steam-ironing on a dummy, it will be noted that, although this means is relatively productive, the results obtained are not always as satisfactory as those obtained with a press and/or with a traditional iron, in particular in the ironing of some types of textiles.

If the advantages and disadvantages of the various known means described hereinabove are considered, it will be noticed that the systematic ironing of a large number of articles, for example in the field of clothing and furnishing, would have to go through partial-treatment operations on the press for their large surface areas and through finishing operations on work stations equipped with an ironing table and a traditional iron. In this process it will be noticed that the saving in time obtained by using the press will be lost in part by handling, and that the organization of the work will present considerable stresses.

SUMMARY OF THE INVENTION

The present invention seeks to overcome these disadvantages by providing an ironing device which, in the same work station, brings the advantages of the press, the flexibility of use of the traditional iron, and enables production to be doubled when ironing a large number of modern-day articles such as, for example, raincoats, jackets and similar garments and other furnishings.

To this end, the subject of the present invention is an ironing device which can be installed and work on an ironing table traditionally used in a workshop having a movable ironing plate which applies heat and steam, mechanically assisted in its use movements and having a work surface of, for example, at least four to five times that of a traditional iron.

According to a main feature of the invention, the ironing plate is assisted mechanically in its lowering, in the application of pressure to the article to be treated and in its displacement in all directions in order to effect the ironing at the discretion of the operator with the same flexibility as when using a traditional iron.

According to a preferred embodiment of the invention, the ironing plate is joined mechanically by its upper part to the free end, directed downwards, of the rod of a vertical double-action jack, preferably pneumatic, capable of ensuring its lowering, its application of pressure to the article to be ironed and its rising after use.

According to an advantageous embodiment of the invention, the rear end, directed upwards, of the body of the said vertical jack is integral with a movable carriage equipped with rollers which enable it to be displaced in a to-and-fro movement in a running track situated in a horizontal plane above the ironing table and the axis of travel of which is directed perpendicular to the longitudinal axis of the latter, the said running track forming a component part of a second carriage, also equipped with rollers which enable it to be displaced in a to-and-fro movement in a running track situated in a horizontal plane above the said first and second carriages and the axis of travel of which is directed substantially parallel to the longitudinal axis of the ironing table.

The two carriages are advantageously displaced respectively by at least one mechanical means, for example an electric motor with two directions of rotation and via a synchronous belt or by any other means enabling the desired effect to be transmitted, such as an endless screw, a rack, or any other type of belt or transmission enabling displacement of the ironing plate to be ensured in all the desired directions at a displacement speed at least equal to that of a traditional iron operated by an experienced user.

The ironing plate also preferably has, on its upper part, the members intended to control its operation, comprising at least a first control which enables its lowering and its rising to be actuated with ease so as to be able to place the article to be treated on the table and to displace it during operation, and at least one second control which enables the operator to actuate the displacement of the said ironing plate over the article to be treated in all the desired directions so as to carry out the work in good conditions and without fatigue, with the same ease and flexibility as when using a traditional iron, the application of steam being performed preferably via a foot control or via a third control, also placed on the ironing plate.

In an alternative embodiment of the invention, the ironing plate is mechanically assisted only in its lowering, in its rising, and in its bearing on the article to be ironed, applies heat and steam but does not have any motorization to assist its displacement and will, in this embodiment, be used by the operator.

Lastly, according to a significant embodiment of the invention, the device is supported by at least one bracket which stands on the ground or on the support frame of the ironing table, and at least one of the two running tracks will enable the ironing plate to be displaced out of the vertical of the working plane in order to be able to use the said ironing table and its accessories for their original purpose.

The invention will be better understood from the description given hereinbelow merely as a guide and by way of non-limiting example which will enable the attendant advantages and features to become apparent.

BRIEF DESCRIPTION OF THE DRAWINGS

Reference will be made to the attached drawings in which.

DESCRIPTION OF THE PREFERRED EMBODIMENTS

Figure 1:
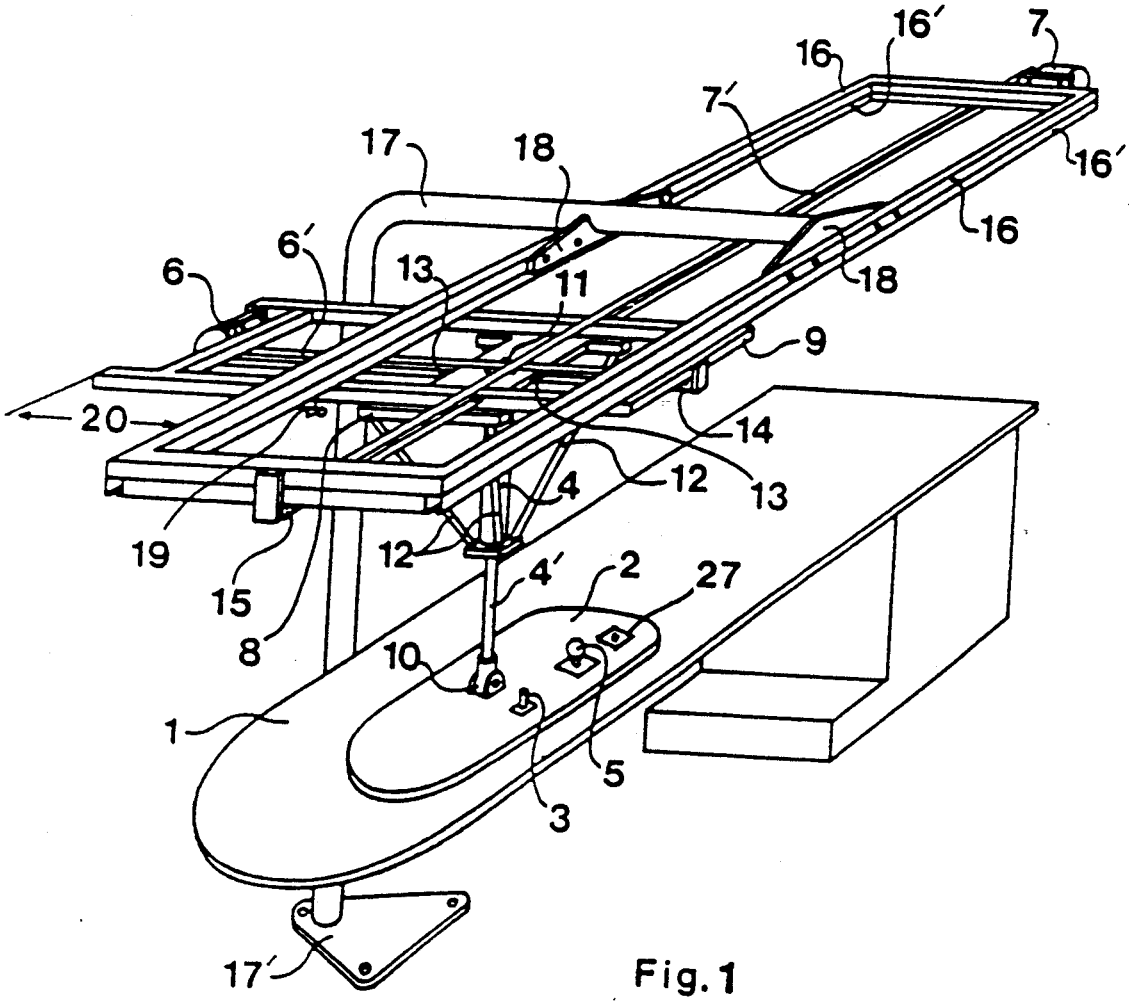
FIG. 1 illustrates in a general perspective view a preferred embodiment of the invention.

Referring first to FIG. 1 which shows, in a general view, a preferred and non-limiting embodiment of the invention and in which view 1 the ironing table (1) is shown for the sole purpose of showing the invention in its use context, there can be seen the ironing plate (2) equipped with a means (3) for manually controlling the pneumatic jack (4) acting on the lowering, the application of pressure and the rising of the said plate (2) and with a control means (5) acting, by tilting it by hand forwards, backwards, to the right and to the left, on the operation in one direction or the other of the two electric motors (6) and (7) for controlling the displacement of the carriages (8) and (9) respectively which cause the simultaneous displacement of the ironing plate (2) at the discretion of the operator, the connection (10) of the ironing plate (2) to the free end of the rod (4') of the jack (4) performed by means of an articulated bearing, the fastening point (11) of the other end of the body of the jack (4) being on the carriage (8) while the other end of the said jack (4) is held in place on the same carriage by four struts (12) one of which, hidden by the jack (4), is not visible in the drawing, the motor (6) with two directions of rotation integral with the carriage (9) displacing the carriage (8) via a synchronous belt (6'), the two ends of which are connected integrally at (13) on either side of the said carriage (8) while the return travel of the said belt (6') takes place on the loose pulley (14), the motor (7) with two directions of rotation and the loose pulley (15) which are integral with the frame (16) which has the running track (16') for the carriage (9) displacing the said carriage (9) via a synchronous belt (7') having the same mounting as on the carriage (8), and lastly the bracket (17) with its foot (17') for fastening to the ground which supports the whole of the device via its means for assembly (18) to the frame (16). In the embodiment shown here, steam admission (25) to the ironing plate (2) is via a foot control (26). Alternatively, as shown in FIG. 1, a control switch (27) may be used for this purpose. A safety means cuts off the electrical supply of the motors (6) and (7) via a relay controlled by compressed air which takes effect upon the cutting off of the air pressure employed for the lowering of the jack (4) as soon as the ironing plate (2) has risen, a microcontact switch (19) in a similar manner limits the action of the motor (6) to the work surface, preventing any displacement of the carriage (8) into the (zone (20) intended) receiving the carriage (8) for when idle in order to prevent any risk of the ironing plate (2) being held in a position which does not lie directly over the ironing table (1). A solenoid valve, also controlled by the microcontact (19), prevents the ironing plate (2) from descending into the zone (20) by acting on the closure of the air inlet to the jack (4). Moreover, the bearing pressure of the ironing plate (2) on the article to be treated can be adjusted by acting on the pressure of the air admitted to the jack (4) and the lowering and rising speeds by acting on the rate of the escapes of the air opposing the displacement of the piston of the said jack (4).

We have already seen the performance of a device of this type which enables, at the same work station, large surface areas to be treated effectively and rapidly without the operator becoming tired, whilst at the same time also enabling the work surface to be freed rapidly in order to carry out any finishing treatments or to perform other tasks using the traditional iron, allowing the ironing table and the sleeve-board to be used with ease.

Figure 2:
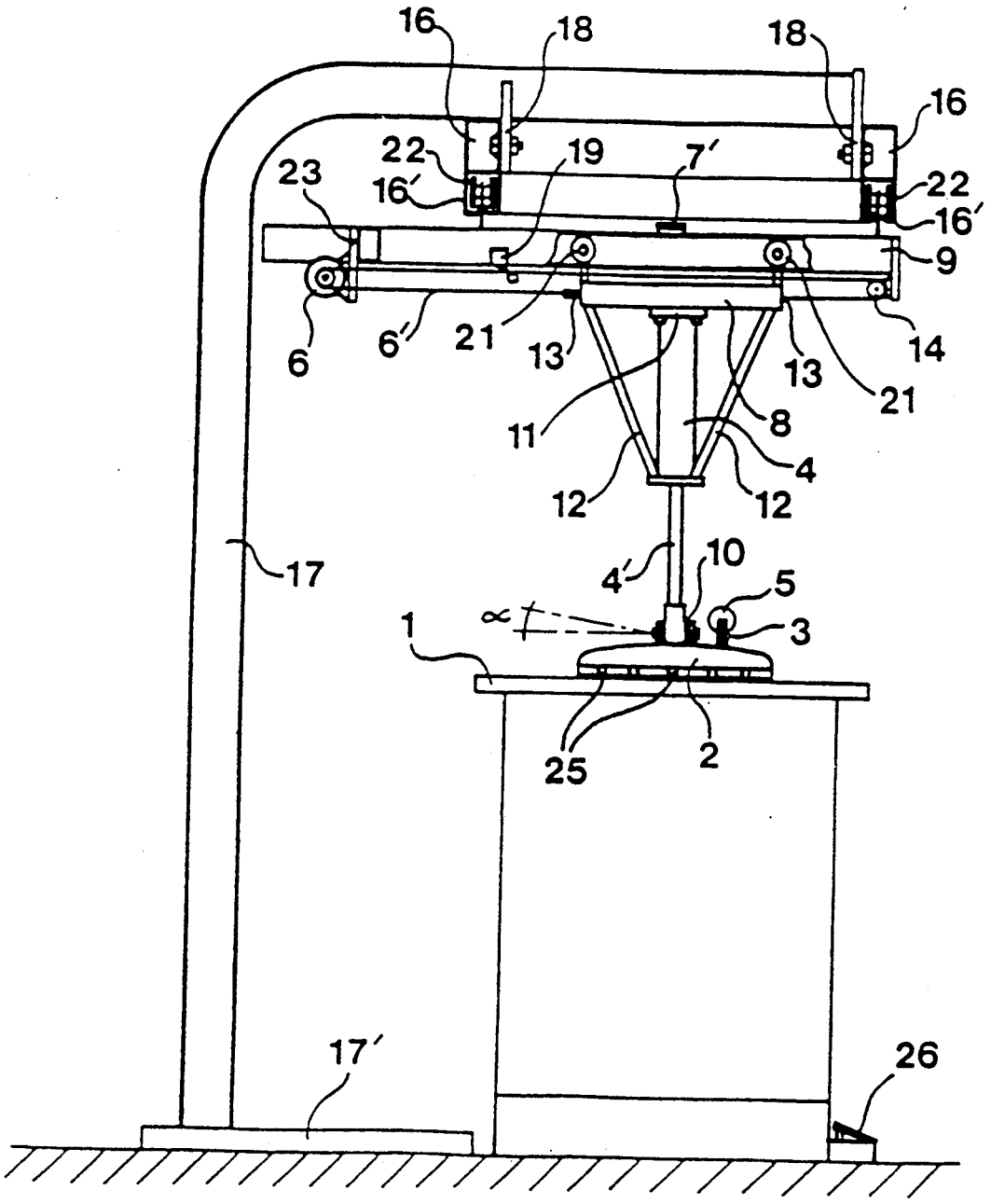
FIG. 2 shows in a partial sectional view a preferred method of mounting the carriages, running tracks, vertical jack and ironing plate.

In the FIG. 2, which shows, in a partial sectional view, details of the device in FIG. 1, there can be seen the ironing table (1), the ironing plate (2) equipped with controls (3) and (5) for lowering, rising and displacement, the means (10) for connecting the ironing plate (2) to the rod (4') of the pneumatic jack (4) consisting of an articulated bearing which allows it an inclination $\alpha$ of at least five degrees, the said jack (4) fastened by its top part at (11) to the carriage (8) and held in place in its vertical position by the struts (12), the rollers (21) integral with the carriage (8) enabling the displacement and guidance of the said carriage (8) in the running tracks made from tubular shaped sections which form an integral part of the carriage (9), the rollers (22) integral with the said carriage (9) ensuring its displacement and its guidance in the running tracks (16') made from tubular shaped sections which are themselves integral with the two side bars (16) which form the frame of the whole of the device supported by the bracket (17) via assembly means (18).

In this same FIG. 2, which also shows a preferred and non-limiting form of mounting the mechanical displacement means for the carriage (8), the displacement means for the carriage (9) which are not shown here being identical to those for the carriage (8), there can be seen the electric motor (6) with two directions of rotation mounted on a support (23) integral with one of the ends of the carriage (9), the loose pulley (14) integral with the other end of the said carriage (9) ensuring the return of the synchronous belt (6'), the two ends (13) of which are connected mechanically and integrally to the carriage (8) in order to displace the latter by traction in one direction or the other of the rotation of the motor (6), one of the ends (13) of the said belt (6') being equipped with a means allowing its tension to be adjusted.

It should be pointed out, as it will have already been possible to understand from the description above, that the mechanical displacement of the ironing plate (2) is carried out in eight directions along four axes, in other words in two directions along two horizontal axes, one of which, as has already been seen, is parallel and the other perpendicular to the longitudinal axis of the ironing board (1) by acting via the control (5) on one or the other direction of rotation of one or other of the motors (6) or (7), and in two directions along two other horizontal and perpendicular axes offset by 45° relative to the first two by acting via the same control (5) on the simultaneous operation of the two motors (6) and (7) in one or other of their directions of rotation In order to actuate and determine the displacement of the ironing plate (2), after having lowered the latter to apply pressure to the article to be treated via the control (3), the control (5) is tilted by the operator applying pressure by hand in the directions in which he wishes the said ironing plate (2) to be displaced in order to carry out the ironing operation similarly to when a traditional iron is used.

In an alternative method of mounting the jack (4) according to the invention, the latter is equipped with a guide means having at least two columns.

In an alternative embodiment of the device according to the invention, the running tracks (9) and (16) consist of guide columns and the carriages (8) and (9) are equipped with ball bearings.

In an alternative embodiment of the device according to the invention, the control of the admission of steam to the ironing plate (2) is situated on the said ironing plate (2).

In an alternative embodiment- of the device according to the invention, the ironing plate (2) is equipped with a guide handle.

In an alternative embodiment of the device according to the invention, the electric motors (6) and (7) and the belts (6') and (7') are replaced by pneumatic or hydraulic jacks actuated by the control (5) .

In another alternative embodiment of the invention, the device does not have any motorization for displacing the carriages (8) and (9) and the displacement of the ironing plate (2) is in this case by hand and is performed by the operator.

The invention is advantageous because it provides a solution which makes it possible to reduce handling between work stations and also to double production when ironing a large number of articles, whilst at the same time reducing the fatigue of the operators in many tasks which are currently carried out on an ironing table.

The invention is chiefly applied to ironing articles of clothing and furnishings made from textile, skin and leather.

It is not limited to the description which has just been given but, on the contrary, embraces all the alternatives which could be applied to it without going beyond either its scope or its spirit.

I claim:

1. An ironing device for use with a conventional ironing table, comprising:

a moveable ironing plate, having at least one flat surface and means for applying heat therethrough;

pneumatic jack means, arranged integral with the ironing plate, for displacing the ironing plate vertically, and supported by guide means including at least two struts;

first and second carriage means, for displacing the ironing plate horizontally along first and second main axes, the first and second axes being perpendicular to each other;

bracket means for supporting the first and second carriage means over the ironing table;

first and second motor means, operatively associated with the first and second carriage means, each motor means being rotatable in two directions, and so arranged with the respective carriage as to cause movement of the ironing plate in one direction or another along the main axes depending on the direction of rotation of the motor means; and manual control means for controlling and coordinating operation of the first and second motor means, including a switch operatively associated with the first and second motor means so that the motor means will cause the ironing plate to move in a pre-determined direction in accordance with operation of the switch.

2. An ironing device for use with a conventional ironing table, comprising:

a moveable ironing plate, having at least one flat surface and means for applying heat therethrough;

pneumatic jack means, arranged integral with the ironing plate, for displacing the ironing plate vertically, and supported by guide means;

first and second carriage means, for displacing the ironing plate horizontally along first and second main axes, the first and second axes being perpendicular to each other;

bracket means for supporting the first and second carriage means over the ironing table;

first and second motor means, operatively associated with the first and second carriage means, each motor means being rotatable in two directions, and so arranged with the respective carriage as to cause movement of the ironing plate in one direction or another along the main axes depending on the direction of rotation of the motor means;

first safety means, operatively associated with the jack means and the motor means, for preventing the motor means from moving the carriage means when the jack means is disposing the ironing plate at a distance above the surface of the ironing table; and manual control means for controlling and coordinating operation of the first and second motor means, including a switch oepratively associated with the first and second motor means so that the motor means will cause the ironing plate to move in a pre-determined direction in accordance with operation of the switch.

3. An ironing device as in claim 1, further comprising safety means, operatively associated with the jack means and the first and second motor means, for preventing the first and second motor means from moving the carriage means when the jack means is disposing the ironing plate at a distance above the surface of the ironing table.

4. An ironing device as in claim 1, further comprising safety means, operatively associated with the jack means and the motor means, whereby the jack means is prevented from lowering the ironing plate to an area not on the ironing table.

5. An ironing device as in claim 1, wherein at least one of the motor means is disposed out of a zone of space defined above the surface of the ironing table and away from a region occupied by an operator of the ironing device.

6. An ironing device as in claim 1, wherein the motor means are operatively connected to the respective carriage means by endless belts.

7. An ironing device as in claim 1, wherein the manual control means controls automatic motion of the ironing plate in two directions along either of the main axes, and in two directions along two additional axes extending diagonally with respect to the main axes.

8. An ironing device as in claim 1, further comprising steam means for selectably conveying steam through the ironing plate.

9. An ironing device as in claim 8, further including a foot control switch for operating the steam means.

10. An ironing device as in claim 8, wherein a control switch for operating the steam means is disposed on the ironing plate.

11. An ironing device as in claim 1, further comprising means for manually controlling the pneumatic jack means, for raising and lowering the ironing plate.

12. An ironing device as in claim 1, further including means for adjusting bearing pressure of the ironing plate against the ironing table, and for regulating lowering and rising speeds of the ironing plate caused by the jack means.

* * * * *